US009669961B2

(12) United States Patent
Tada et al.

(10) Patent No.: US 9,669,961 B2
(45) Date of Patent: Jun. 6, 2017

(54) THREE-PIECE CAN AND METHOD OF MANUFACTURING THE SAME

(71) Applicant: JFE Steel Corporation, Tokyo (JP)

(72) Inventors: Masaki Tada, Fukuyama (JP); Katsumi Kojima, Fukuyama (JP); Hiroki Nakamaru, Fukuyama (JP); Yoichi Tobiyama, Chiba (JP)

(73) Assignee: JFE Steel Corporation (JP)

( * ) Notice: Subject to any disclaimer, the term of this patent is extended or adjusted under 35 U.S.C. 154(b) by 238 days.

(21) Appl. No.: 14/405,409

(22) PCT Filed: Jun. 3, 2013

(86) PCT No.: PCT/JP2013/003481

§ 371 (c)(1),
(2) Date: Dec. 4, 2014

(87) PCT Pub. No.: WO2013/183274

PCT Pub. Date: Dec. 12, 2013

(65) Prior Publication Data

US 2015/0136635 A1 May 21, 2015

(30) Foreign Application Priority Data

Jun. 6, 2012 (JP) ..... 2012-128739

(51) Int. Cl.

| | |
|---|---|
| ***C21D 9/48*** | (2006.01) |
| ***C21D 8/04*** | (2006.01) |
| ***C22C 38/02*** | (2006.01) |
| ***C22C 38/04*** | (2006.01) |
| ***C22C 38/06*** | (2006.01) |
| ***B21D 51/26*** | (2006.01) |
| ***B65D 6/00*** | (2006.01) |
| ***C21D 9/46*** | (2006.01) |
| ***C22C 38/00*** | (2006.01) |
| ***B65D 8/00*** | (2006.01) |
| ***C21D 8/02*** | (2006.01) |

(52) U.S. Cl.

CPC ..... *B65D 7/42* (2013.01); *B21D 51/26* (2013.01); *B65D 7/04* (2013.01); *C21D 8/0273* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01)

(58) Field of Classification Search
None
See application file for complete search history.

(56) References Cited

U.S. PATENT DOCUMENTS

2011/0076177 A1* 3/2011 Aratani ..... C21D 8/0473 420/87

FOREIGN PATENT DOCUMENTS

| | | | |
|---|---|---|---|
| JP | 60-128212 | A | 7/1985 |
| JP | 10-237550 | | 9/1998 |
| JP | 2000-282289 | A | 10/2000 |
| JP | 2001-279372 | | 10/2001 |
| JP | 2002-294399 | A | 10/2002 |
| JP | 3663918 | B2 | 6/2005 |
| JP | 2009-084687 | A | 4/2009 |
| JP | 4276388 | B2 | 6/2009 |
| JP | 2009-174055 | A | 8/2009 |
| JP | 2009-263788 | A | 11/2009 |

OTHER PUBLICATIONS

Chinese Office Action dated May 16, 2016, of corresponding Chinese Application No. 201380029333.0, along with a Concise Statement of Relevance of Office Action in English.
Supplementary European Search Report dated Jul. 20, 2015 of corresponding European Application No. 13800513.7.
Chinese Office Action dated Dec. 12, 2016, of corresponding Chinese Application No. 2013800293330, along with a Concise Statement of Relevance of Office Action in English.
Japanese Office Action dated Aug. 11, 2015, of corresponding Japanese Application No. 2014-519833, along with a Concise Statement of Relevance of Office Action in English.
Japanese Office Action dated Mar. 17, 2015, of corresponding Japanese Application No. 2014-519833, along with a Concise Statement of Relevance of Office Action in English.

* cited by examiner

*Primary Examiner* — Deborah Yee
(74) *Attorney, Agent, or Firm* — DLA Piper LLP (US)

(57) ABSTRACT

A three-piece can includes a can body obtained by forming a steel sheet such that a roundness of the can is 0.34 mm or less. The steel sheet contains: by mass %, C: 0.020% or more and 0.100% or less; Si: 0.10% or less; Mn: 0.10% or more and 0.80% or less; P: 0.001% or more and 0.100% or less; S: 0.001% or more and 0.020% or less; Al: 0.005% or more and 0.100% or less; and N: 0.0130% or more and 0.0200% or less. The balance is Fe and inevitable impurities. The steel sheet has a yield strength of 440 MPa or more and a total elongation of 12% or more.

2 Claims, No Drawings

THREE-PIECE CAN AND METHOD OF MANUFACTURING THE SAME

TECHNICAL FIELD

This disclosure relates to a high-strength three-piece can and a method of manufacturing the three-piece can.

BACKGROUND

In the industry of a steel sheet for a can, thinning of the sheet thickness is promoted as countermeasures for cost reduction (weight reduction) of the can and environmental protection. The steel sheet as a material for a can requires a strength corresponding to the sheet thickness. To ensure the can strength despite thinning of the sheet, a yield strength of about 440 MPa or more is required. There is a concern about reduction of the can strength in association with the reduction in sheet thickness. Studies and developments have been made for countermeasures of this concern up to the present. A steel sheet with the steel sheet strength ensured by addition of C of 0.08 mass % or more to increase the strength of the steel sheet, a double reduced steel sheet (DR steel sheet) with the steel sheet strength increased by performing the second cold rolling for work hardening after cold rolling and annealing, and the like have been developed. However, all of them have problems. Since the high C amount of 0.08 mass % or more causes the steel component region of the hypo-peritectic region during solidification in continuous casting, slab cracking occurs due to peritectic reaction. For the DR steel sheet, the strength of the steel sheet is increased. However, this simultaneously causes a decrease in elongation due to work hardening, thus causing the occurrence of cracking during flanging processing. Furthermore, as the lid of a beverage can or a food can, an easy open end (EOE) is widely used. When the EOE (can lid) is manufactured, it is necessary to shape a rivet to mount a tab by bulging processing and drawing processing. The ductility of the material required for such processing corresponds to the total elongation of about 12% in a tensile test.

The material of can body among the three parts of a three-piece beverage can, which is constructed by seaming the lid and the bottom on the can body, is formed in a pipe shape. Subsequently, flanging is performed on both ends of the can body to attach the lid and the bottom by seaming. Therefore, the end parts of the can body also requires a total elongation of about 12%.

For the conventionally used DR steel sheet, the strength can be increased by work hardening. However, at the same time, there has been a problem that the work hardening reduces the total elongation, thus causing inferior processability.

Furthermore, the steel sheet goes through a surface treatment process and is shipped out as a steel sheet for a can. Subsequently, the steel sheet is further subjected to coating, a slitting process, and processing by roll-forming and then welded by a welder. Subsequently, the steel sheet is heated after repair coating of the welded part and goes through necking and flanging, seaming of a bottom lid, internal coating, and a coating-baking process to be a product. Furthermore, the product is filled with its contents and an upper lid is seamed on the product. Subsequently, the product is sterilized by heat in a retort process. When this retort sterilization is performed, it is necessary to keep can strength against an external pressure applied by retort vapors for a can that has a negative pressure inside. When the can strength is lower than the external pressure, dents in the can surface part result. In recent years, to realize can weight reduction taking into consideration the environment, the raw material for a can is thinned. To keep the can strength, a high strength material such as a DR material is used. However, using the thin high strength material reduces shape fixability, thus preventing formation of a cylindrical shape after a roll forming process.

Japanese Patent No. 3663918 discloses a technique of a steel sheet for a can and a method of manufacturing the steel sheet. The steel sheet contains C: 0.01 to 0.10 wt % and Mn: 0.1 to 1.0 wt % and has a Young's modulus E of 170 GPa or less. A roundness of a cylinder portion obtained by forming the steel sheet is less likely to change and the steel sheet is excellent in shape keeping property. Japanese Patent No. 4276388 discloses a technique of a high strength thin steel sheet for a welded can excellent in flange formability and a method of manufacturing the thin steel sheet. The thin steel sheet contains, by mass %, C: more than 0.04% and 0.08% or less, Si: 0.02% or less, Mn: 1.0% or less, P: 0.04% or less, S: 0.05% or less, Al: 0.1% or less, and N: 0.005 to 0.02% or less. The sum of solid solute C and solid solute N in the steel sheet is 50 ppm≤solid solute C+solid solute N≤200 ppm, the solid solute C in the steel sheet is 50 ppm or less, and the solid solute N in the steel sheet is 50 ppm or more. The balance is Fe and inevitable impurities.

However, all of the above-described conventional techniques have problems as follows.

In the steel sheet described in JP '918, to reduce the Young's modulus, it is necessary to perform rolling at a transformation point or below in finish rolling of hot rolling. This increases the rolling load and it is difficult to manufacture the steel sheet. Additionally, uniformity of the quality of the material in the width direction decreases considerably. In the steel sheet described in JP '388, to increase the strength, it is necessary to perform primary cold rolling and annealing and then perform secondary cold rolling at a high rolling reduction. Thus, a cost increase is unavoidable. Furthermore, in the DR steel sheet, performing the secondary cold rolling after annealing reduces the total elongation. This does not ensure a total elongation of 12% or more in every part in the width and longitudinal directions of a coil.

It could therefore be helpful to provide a three-piece can and a method of manufacturing the three-piece can which is excellent in workability to form a steel sheet having a yield strength of 440 MPa or more and total elongation of 12% or more, which is preferred as a material for three-piece can body, in a cylindrical shape close to a true circle such that roundness of the can after can forming is 0.34 mm or less.

SUMMARY

We discovered the following:

(1) While increasing strength by addition of an appropriate amount of N, a rapid cooling after an annealing at a recrystallization temperature or higher is performed to keep C and N in super-saturated states and, thus, strength and elongation are ensured.

(2) Using a high N steel and further using strain aging hardening with C and N allow causing low yield strength during roll forming to make easy formation of a cylindrical shape with a satisfactory roundness. After roll forming, application of baking processes after the repair coating of the welded part and the internal coating of the can allow increasing the strength by strain aging hardening.

(3) The roll formability of the raw material is satisfactory because of (2). Accordingly, the gate adjustment during welding is facilitated and manufacturing of a can excellent in roundness is ensured.

(4) Specifying the roundness of the can avoids dents on the can due to the pressure concentration on a portion with a poor roundness when an external pressure is received in a retort (autoclaving and heating) sterilization process.

The strain aging hardening is a hardening method in which the amount of the solid solutes C and N in the steel sheet is increased and strain is introduced by temper rolling or the like such that a dislocation is formed to generate a stress field, C and N atoms aggregate at the periphery of the dislocation, and that the dislocation is fixed to increase the strength.

We thus provide:

[1] A three-piece can which includes a can body obtained by forming a steel sheet such that a roundness of the can is 0.34 mm or less. The steel sheet contains: by mass %, C: 0.020% or more and 0.100% or less; Si: 0.10% or less; Mn: 0.10% or more and 0.80% or less; P: 0.001% or more and 0.100% or less; S: 0.001% or more and 0.020% or less; Al: 0.005% or more and 0.100% or less; and N: 0.0130% or more and 0.0200% or less. Balance is Fe and inevitable impurities. The steel sheet has a yield strength of 440 MPa or more and a total elongation of 12% or more.

[2] A method of manufacturing a three-piece can which includes forming a steel sheet into a can body such that a roundness of the can is 0.34 mm or less. The steel sheet contains: by mass %, C: 0.020% or more and 0.100% or less; Si: 0.10% or less; Mn: 0.10% or more and 0.80% or less; P: 0.001% or more and 0.100% or less; S: 0.001% or more and 0.020% or less; Al: 0.005% or more and 0.100% or less; and N: 0.0130% or more and 0.0200% or less. Balance is Fe and inevitable impurities. The steel sheet has a yield strength of 440 MPa or more and a total elongation of 12% or more.

All of % indicate the component of the steel is mass %. In the steel sheet, high strength means a yield strength of 440 MPa or more and high processability means a total elongation of 12% or more.

DETAILED DESCRIPTION

Hereinafter, cans and methods will be described in detail. In the following description, all of the units of content of the respective elements in the steel component composition are "mass %," and hereinafter, "%" is simply used unless otherwise stated.

The three-piece can includes a can body obtained by forming a steel sheet such that a roundness of the can is 0.34 mm or less. The steel sheet has a predetermined component, and has a yield strength of 440 MPa or more and a total elongation of 12% or more.

This steel sheet can be manufactured by using a steel that contains N of 0.0130% or more and 0.0200% or less and setting a coiling temperature after hot rolling, a temper rolling reduction, an annealing temperature, and a cooling rate under appropriate conditions. Increasing the annealing temperature improves the ductility of the steel sheet, thus improving the processability of the can.

A description will be given of the component composition of the steel sheet.

C: 0.020% or More and 0.100% or Less

The N amount is increased to ensure high strength. On the other hand, the C amount is increased to provide high strength. If the C amount is less than 0.020%, the yield strength of 440 MPa required to obtain remarkable economic effects by thinning the steel sheet cannot be obtained. Accordingly, the lower limit of the C amount is 0.020%. On the other hand, if the C amount exceeds 0.100%, the C amount is in a hypo-peritectic region and the steel becomes excessively hard. This reduces hot ductility during casting. Thus, slab cracking or the like is likely to occur and it becomes difficult to manufacture a thin steel sheet while ensuring processability. Accordingly, the upper limit of the C amount is 0.100%, preferably, 0.020% or more and 0.080% or less.

Si: 0.10% or Less

A Si amount exceeding 0.10% causes problems such as reduction in surface treatability and deterioration in corrosion resistance. Thus, the upper limit is 0.10%. On the other hand, an amount of less than 0.003% causes an excessive refining cost. Thus, the lower limit is preferred to be 0.003%.

Mn: 0.10% or More and 0.80% or Less

Mn prevents red shortness by S during hot rolling and refining crystal grains, thus being an element required to ensure a preferred material property. Furthermore, satisfying can strength with a thinned material requires an increase of the strength of the material. To ensure this increase in strength, the lower limit of the Mn amount is 0.10%. On the other hand, excessively adding Mn in large amount causes deterioration in corrosion resistance and causes an excessively hard steel sheet. Thus, the upper limit is 0.80%.

P: 0.001% or More and 0.100% or Less

P is a harmful element that hardens the steel and deteriorates processability and, at the same time, deteriorates corrosion resistance. Thus, the upper limit is 0.100%. On the other hand, setting P to be less than 0.001% causes an excessive dephosphorization cost. Thus, the lower limit is 0.001%.

S: 0.001% or More and 0.020% or Less

S is a harmful element that exists as an inclusion in the steel and causes a reduction in ductility and deterioration in corrosion resistance. Thus, the upper limit is 0.020%. On the other hand, S less than 0.001% causes an excessive desulfurization cost. Thus, the lower limit is 0.001%.

Al: 0.005% or More and 0.100% or Less

Al is an element required as a deoxidizer during steelmaking. An insufficient additive amount causes insufficient deoxidation and increases the inclusion, thus deteriorating the processability. Accordingly, it is necessary to have a lower limit of 0.005% to perform sufficient deoxidation. On the other hand, a content exceeding 0.100% increases the occurrence frequency of the surface defect caused by alumina clusters or the like. Thus, the upper limit of the Al amount is 0.100%.

N: 0.0130% or More and 0.0200% or Less

Adding N in an excessive amount induces traps of N bubbles during casting in a slab surface layer. Accordingly, blowholes increase and surface defects occurs. Thus, the surface quality is likely to degrade. This deteriorates hot ductility and causes cracking of the slab in continuous casting. Thus, the upper limit is 0.0200%. From the aspect of keeping the steel sheet strength, the lower limit of N amount is 0.0130% and, preferably, 0.0150% or more and 0.0180% or less. Setting the N amount to 0.0180% or less especially suppresses the reduction in surface quality and deterioration in hot ductility. An N amount of 0.0150% or more especially facilitates keeping the steel sheet strength. Thus, this amount is preferred.

The balance includes Fe and unavoidable impurities.

The following describes the mechanical property of the steel sheet.

The yield strength is 440 MPa or more. The yield strength of less than 440 MPa does not enable to make the steel sheet thin enough such that remarkable economic effects are obtained while ensuring the strength of the steel sheet as the material for a can. Thus, the yield strength is 440 MPa or more.

The total elongation is 12% or more. The total elongation of less than 12% causes cracking during flanging for the three-piece can. Even for application to the EOE (can lid), cracking occurs during rivet processing. Accordingly, the total elongation is 12% or more.

The above-described tensile strength and the above-described total elongation can be measured by a method of tensile test for metallic materials shown in "JIS Z 2241."

The following describes the roundness of the can.

The roundness of the can is 0.34 mm or less. Setting the roundness of the can to 0.34 mm or less allows for a can strength of 0.147 MPa or more that prevents collapse of the can due to the external pressure after termination of the retort sterilization. The roundness of the can is controlled by: (1) controlling the shape by changing the stress during roll-forming in can body processing and controlling the amount of springback after the can body processing by changing the N amount; and (2) adjustment of the clearance between a gate roller, which keeps the shape of the can during welding and sends out the can, and the can body. Additionally, as illustrated in "JIS B 0621," the roundness of the can can be obtained with the difference in radius between two circles when a circular form (the can body) is sandwiched by two geometric circles in a concentric manner such that the interval between the two concentric circles becomes minimum. The roundness in the circumferential direction (the cross section of the can body) of the can body is the roundness of the can.

The roundness of the can can be measured by a roundness measurement method shown in "JIS B 0621" and "JIS B 0021" using roundness measurement equipment specified in "JIS B 7451." For the measurement of the roundness, the can on which the upper lid and the bottom lid were mounted was used. The center part in the height direction of the can body was measured in the circumferential direction. The testing method of springback was performed with a method shown in "JIS G 3303," and a springback angle θ(°) was used as an evaluation index.

Using a high N steel and additionally using strain aging hardening with C and N allow increasing the strength. That is, setting C and N as the composition range, when the amount of the solid solutes C and N is increased and strain is introduced by temper rolling or the like, a dislocation occurs to generate a stress field. This causes aggregation of C and N atoms at the periphery of the dislocation. This allows fixing the dislocation to increase the strength.

The following describes a method of manufacturing a steel sheet to be used for the three-piece can.

The steel sheet to be used for the three-piece can is produced from a steel slab that includes the above-described composition manufactured by continuous casting. This steel slab is subjected to hot rolling and then coiling at a temperature less than 620° C., and then primary cold rolling at a primary cold rolling reduction exceeding 85%. Annealing is performed at a soaking temperature of 620° C. or higher and 780° C. or lower. Subsequently, cooling is performed at a cooling rate of 80° C./sec or more and 300° C./sec or less. Subsequently, temper rolling is performed at a rolling reduction of less than 5%. Thus, the steel sheet is produced. Annealing is performed at a recrystallization temperature or higher to complete recrystallization during the annealing.

Coiling Temperature after Hot Rolling: Less than 620° C.

The coiling temperature after hot rolling at 620° C. or higher might cause the solid solute N secured to increase the yield strength to precipitate again as AlN to cause reduction in yield strength. Thus, the coiling temperature after hot rolling is preferred to be less than 620° C., further preferably, 590° C. or less, more preferably, 560° C. or less.

Primary Cold Rolling Reduction: More than 85%

When the primary cold rolling reduction is small, it is necessary to increase the reduction of hot rolling to finally obtain an ultrathin steel sheet. Increasing the hot rolling reduction means thinning the hot-rolled material. This promotes cooling and makes it difficult to ensure the finishing temperature. Thus, this is not preferred. With the reasons described above, the primary cold rolling reduction is preferred to be more than 85%, more preferably, 90% or more and 92% or less.

Annealing

During annealing, heating is performed at a recrystallization temperature or higher. From the aspect of the efficiency of operation and prevention of fracture of the thin steel sheet during annealing, the soaking temperature is preferred to be 620 to 780° C. Furthermore, to ensure the target yield strength of 440 MPa or more, it is preferred to perform rapid cooling at a cooling rate of 80° C./sec or more and 300° C./sec or less after heating. This allows ensuring super-saturated C and N. More preferably, the cooling rate is 80° C./sec or more and 130° C./sec or less. A gas jet device can be used for the cooling.

Temper Rolling Reduction: 5% or Less

The temper rolling reduction is preferred to be 5% or less. The temper rolling reduction of more than 5% increases the load on the temper rolling mill, thus causing an excessive processing load. Additionally, a slip of the steel sheet and a jumping phenomenon are likely to occur. Thus, performing temper rolling becomes difficult. Accordingly, the temper rolling reduction is preferred to be 5% or less, more preferably, 0.5% or more and 3.5% or less.

After temper rolling, a process such as surface treatment is performed in the usual manner to finish the steel sheet as a steel sheet for a can.

As the method of manufacturing the three-piece can, surface treatment such as plating and lamination is performed on the steel sheet for the can obtained by the above-described method. As necessary, printing and coating are performed. Subsequently, the obtained raw material is cut in a predetermined size as a rectangular blank. Furthermore, after this, roll-forming is performed on the rectangular blank. Subsequently, a can body can be manufactured with a method of seaming the end parts. The lid and the bottom are seamed on the obtained can body to make a three-piece can.

EXAMPLE 1

A steel that contains a component composition illustrated in Table 1 and the balance including Fe and unavoidable impurities was produced in a production converter, and a steel slab was obtained by a continuous casting method. After the obtained steel slab was reheated at 1250° C., hot rolling, primary cold rolling, continuous annealing, and temper rolling were performed on the condition illustrated in Table 2. The finish rolling temperature in the hot rolling was set to 890° C., and pickling was performed after the rolling.

Sn plating was continuously performed on both surfaces of the steel sheet obtained as described above to obtain a tin plate with Sn adhesion amount of 2.8 g/m$^2$ for each surface.

TABLE 1

| | Component composition (mass %) | | | | | | |
|---|---|---|---|---|---|---|---|
| No | C | Si | Mn | P | S | Al | N |
| A | 0.019 | 0.01 | 0.24 | 0.010 | 0.010 | 0.041 | 0.0170 |
| B | 0.101 | 0.01 | 0.24 | 0.010 | 0.010 | 0.041 | 0.0170 |
| C | 0.039 | 0.01 | 0.09 | 0.010 | 0.010 | 0.041 | 0.0170 |
| D | 0.039 | 0.01 | 0.81 | 0.010 | 0.010 | 0.041 | 0.0170 |
| E | 0.039 | 0.01 | 0.24 | 0.010 | 0.010 | 0.041 | 0.0120 |
| F | 0.039 | 0.01 | 0.24 | 0.010 | 0.010 | 0.041 | 0.0170 |
| G | 0.090 | 0.01 | 0.24 | 0.010 | 0.010 | 0.041 | 0.0170 |
| H | 0.020 | 0.01 | 0.24 | 0.010 | 0.010 | 0.041 | 0.0170 |
| I | 0.039 | 0.01 | 0.24 | 0.010 | 0.010 | 0.041 | 0.0130 |
| J | 0.039 | 0.01 | 0.24 | 0.010 | 0.010 | 0.041 | 0.0200 |
| K | 0.039 | 0.01 | 0.24 | 0.010 | 0.010 | 0.041 | 0.0151 |

TABLE 2

| No. | Steel | Coiling temperature ° C. | Sheet thickness after hot rolling Mm | Primary cold rolling reduction % | Soaking temperature ° C. | Cooling rate ° C./sec | Temper rolling reduction % | Final sheet thickness mm | Yield strength MPa | Total elon-gation % | Round-ness mm | Springback angle ° |
|---|---|---|---|---|---|---|---|---|---|---|---|---|
| 1 | A | 610 | 2.6 | 90 | 650 | 100 | 2.0 | 0.185 | 435 | 11 | 0.35 | 105 |
| 2 | B | 610 | 2.6 | 90 | 650 | 100 | 2.0 | 0.185 | 460 | 9 | 0.33 | 101 |
| 3 | C | 610 | 2.6 | 90 | 650 | 100 | 2.0 | 0.185 | 435 | 11 | 0.35 | 105 |
| 4 | D | 610 | 2.6 | 90 | 650 | 100 | 2.0 | 0.185 | 480 | 9 | 0.33 | 99 |
| 5 | E | 610 | 2.6 | 90 | 650 | 100 | 2.0 | 0.185 | 435 | 12 | 0.33 | 105 |
| 6 | F | 610 | 2.6 | 90 | 660 | 100 | 2.0 | 0.185 | 480 | 13 | 0.32 | 99 |
| 7 | F | 610 | 2.6 | 90 | 660 | 100 | 2.0 | 0.185 | 470 | 13 | 0.32 | 100 |
| 8 | F | 610 | 2.6 | 90 | 650 | 100 | 2.0 | 0.185 | 480 | 13 | 0.30 | 99 |
| 9 | F | 610 | 2.6 | 90 | 650 | 100 | 2.0 | 0.185 | 480 | 13 | 0.29 | 99 |
| 10 | F | 610 | 2.6 | 90 | 640 | 100 | 2.0 | 0.185 | 470 | 12 | 0.21 | 99 |
| 11 | F | 640 | 2.6 | 90 | 650 | 100 | 2.0 | 0.185 | 437 | 14 | 0.35 | 105 |
| 12 | G | 610 | 2.6 | 90 | 650 | 100 | 2.0 | 0.185 | 490 | 12 | 0.33 | 99 |
| 13 | H | 610 | 2.6 | 90 | 650 | 100 | 2.0 | 0.185 | 475 | 14 | 0.33 | 99 |
| 14 | I | 610 | 2.6 | 90 | 650 | 100 | 2.0 | 0.185 | 441 | 14 | 0.33 | 102 |
| 15 | J | 610 | 2.6 | 90 | 650 | 100 | 2.0 | 0.185 | 490 | 12 | 0.33 | 99 |
| 16 | K | 610 | 2.6 | 90 | 650 | 100 | 2.0 | 0.185 | 470 | 12 | 0.33 | 100 |
| 17 | F | 610 | 2.6 | 90 | 640 | 100 | 2.0 | 0.185 | 470 | 12 | 0.35 | 99 |

TABLE 3

| No. | Can strength | Processability | Remarks |
|---|---|---|---|
| 1 | Poor | Good | Comparative Example |
| 2 | Good | Poor | Comparative Example |
| 3 | Poor | Good | Comparative Example |
| 4 | Good | Poor | Comparative Example |
| 5 | Poor | Good | Comparative Example |
| 6 | Good | Good | Example |
| 7 | Good | Good | Example |
| 8 | Good | Good | Example |
| 9 | Good | Good | Example |
| 10 | Excellent | Good | Example |
| 11 | Poor | Good | Comparative Example |
| 12 | Good | Good | Example |
| 13 | Good | Good | Example |
| 14 | Good | Good | Example |
| 15 | Good | Good | Example |
| 16 | Good | Good | Example |
| 17 | Poor | Poor | Comparative Example |

A heat treatment equivalent to baking at 210° C. for 10 minutes after coating was performed on the plated steel sheet (tin plate) obtained as described above. Subsequently, a tensile test was performed. For the tensile test, the yield strength and the total elongation were measured at a tension speed of 10 mm/min using a tensile test specimen in the size of JIS No. 5.

With the following method, the can strength was measured. The can strength is affected by the yield strength and the roundness. For the measurement of the can strength, a sample with a sheet thickness of 0.185 mm was shaped in a can with a can body diameter of 63 mm. The can was inserted into a chamber, compressed air was introduced into the chamber, and the pressure when the can body was deformed was measured. The result in which the can body was not deformed even under the inner pressure of 0.147 MPa was defined as Excellent. The result in which the can lid was deformed under the inner pressure of 0.137 MPa or more and less than 0.147 MPa was defined as Good. The result in which the can lid was deformed under the inner pressure of less than 0.137 MPa was defined as Poor.

Evaluation of the processability was defined as Good when there was no buckling that causes a polygonal line on the can body in parallel to the can height direction after roll forming by a visual check, and defined as Poor when there was buckling.

For the evaluation of roundness, a numerical value measured with a method shown in "JIS B 0621" and "JIS B 0021" using RONDCOM 50A-310 by TOKYO SEIMITSU CO., LTD was employed.

Evaluation of the springback angle θ(°) was performed with a method shown in "JIS G 3303," and the angle of less than 105° was defined as pass.

The test results are illustrated in Tables 2 and 3. From Tables 1 to 3, our examples of Nos. 6 to 10 and Nos. 12 to 16 achieve satisfactory processing and are excellent in strength as the three-piece can. Especially, our example of No. 10 has a small roundness of 0.21 mm, thus being excellent in can strength.

On the other hand, comparative examples are inferior in can strength or processability. The comparative examples of Nos. 1, 3, 11, and 17 have an excessively large roundness of 0.35 mm, thus being inferior in can strength. The comparative example of No. 1 has too little C content, thus lacking the yield strength. The comparative example of No. 2 has too much C content, which causes deterioration in ductility due to temper rolling, thus lacking the total elongation. The comparative example of No. 3 has too little Mn content, thus lacking the yield strength. The comparative example of No. 4 has too much Mn content, which causes deterioration in ductility due to temper rolling, thus lacking the total elongation. The comparative example of No. 5 has too little N content, thus lacking the yield strength. The comparative example of No. 11 has an excessively high coiling temperature, which causes coarsening of the crystal grains, thus lacking the strength.

INDUSTRIAL APPLICABILITY

The three-piece can is excellent in can strength and applicable to various applications requiring the can strength. Additionally, this material is also usable in the lid, the bottom, the EOE, or a two-piece can body.

The invention claimed is:

1. A three-piece can comprising:

a can body obtained by forming a steel sheet having a yield strength, after performing a heat treatment at 210° C. for 10 minutes, of 440 MPa or more and 490 MPa or less and a total elongation, after performing the heat treatment at 210° C. for 10 minutes, of 12% or more such that a roundness of the can as measured according to JIS B 0621 and JIS B 0021 is 0.34 mm or less, the steel sheet containing: by mass %, C: 0.020% or more and 0.100% or less;

Si: 0.10% or less;

Mn: 0.10% or more and 0.80% or less;

P: 0.001% or more and 0.100% or less;

S: 0.001% or more and 0.020% or less;

Al: 0.005% or more and 0.100% or less; and

N: 0.0130% or more and 0.0200% or less, the balance being Fe and inevitable impurities.

2. A method of manufacturing a three-piece can comprising:

forming a steel sheet having a yield strength, after performing a heat treatment at 210° C. for 10 minutes, of 440 MPa or more and 490 MPa or less and a total elongation, after performing the heat treatment at 210° C. for 10 minutes, of 12% or more into a can body such that a roundness of the can as measured according to JIS B 0621 and JIS B 0021 is 0.34 mm or less, the steel sheet containing: by mass %, C: 0.020% or more and 0.100% or less;

Si: 0.10% or less;

Mn: 0.10% or more and 0.80% or less;

P: 0.001% or more and 0.100% or less;

S: 0.001% or more and 0.020% or less;

Al: 0.005% or more and 0.100% or less; and

N: 0.0130% or more and 0.0200% or less, the balance being Fe and inevitable impurities.

* * * * *